US011632638B2

(12) United States Patent
Durrieu

(10) Patent No.: US 11,632,638 B2
(45) Date of Patent: Apr. 18, 2023

(54) METHOD FOR OPERATING A HEARING DEVICE

(71) Applicant: SONOVA AG, Staefa (CH)

(72) Inventor: Jean-Louis Durrieu, Auenstein (CH)

(73) Assignee: Sonova AG, Staefa (CH)

( * ) Notice: Subject to any disclaimer, the term of this patent is extended or adjusted under 35 U.S.C. 154(b) by 71 days.

(21) Appl. No.: 17/333,326

(22) Filed: May 28, 2021

(65) Prior Publication Data

US 2021/0385592 A1 Dec. 9, 2021

(30) Foreign Application Priority Data

Jun. 4, 2020 (EP) ..... 20178207

(51) Int. Cl.
*H04R 25/00* (2006.01)

(52) U.S. Cl.
CPC ..... *H04R 25/65* (2013.01); *H04R 25/505* (2013.01); *H04R 2225/61* (2013.01)

(58) Field of Classification Search
CPC .... H04R 25/603; H04R 25/43; H04R 25/552; H04R 25/554; H04R 2420/07
USPC ..... 381/322
See application file for complete search history.

(56) References Cited

U.S. PATENT DOCUMENTS 11,317,222 B2 * 4/2022 Brouwer ..... H04R 25/453
2021/0185454 A1 * 6/2021 Brouwer ..... H04R 25/505

FOREIGN PATENT DOCUMENTS

DE 10141800 1/2003
EP 2640095 A1 * 9/2013 ..... H04R 25/70
EP 2835987 8/2017
EP 3675524 7/2020

OTHER PUBLICATIONS

Extended European Search Report received in EP Application No. 20178207.5 dated Nov. 4, 2020.

* cited by examiner

*Primary Examiner* — Phylesha Dabney
(74) *Attorney, Agent, or Firm* — ALG Intellectual Property, LLC

(57) ABSTRACT

A method is disclosed for operating a hearing device, comprising a receiver and an active vent. The method includes 1) upon request to switch the active vent into a different state, estimating a transfer function (H, $H_{rec \to mic}$) from the receiver to obtain a first transfer function ($H_a$), 2) subsequently switching the active vent, 3) subsequently estimating a transfer function (H, $H_{rec \to mic}$) from the receiver to obtain a second transfer function ($H_b$), 4) comparing the first transfer function ($\hat{H}_a$) to the second transfer function ($\hat{H}_b$) to obtain a divergence measure (D), 5) concluding that the active vent has actually been switched into the different state if the divergence measure (D) exceeds a threshold ($D_{diff}$).

14 Claims, 2 Drawing Sheets

METHOD FOR OPERATING A HEARING DEVICE

RELATED APPLICATIONS

The present application claims priority to EP Patent Application No. 20178207.5, filed Jun. 4, 2020, the contents of which are hereby incorporated by reference in their entirety.

BACKGROUND INFORMATION

Users of hearing devices have the option to choose between different acoustical coupling systems. In so called Receiver-In-the-Canal (RIC) devices the loudspeaker also referred to as receiver is worn in the ear-canal of the user. The receiver is connected to a controller module which is typically worn behind the ear. The receiver can be comprised in a custom made earpiece or in a dome. Domes are the bell-shaped earpieces at the end of the tube. Depending on the hearing loss and the preferences the user can choose in a range from open to closed domes or a custom earpiece referring to the degree by which a vent hole in the earpiece is open. As used herein, an earpiece which comprises a receiver is referred to as a receiver module.

The mechanical properties of the vent hole in the earpiece strongly influence the occlusion effect and the low frequency amplitude on the eardrum. An open vent has the benefits of less occlusion. The vibration of a person's own voice is reduced.

A closed vent on the other hand has the benefit of a higher low frequency amplitude and is considered beneficial especially when listening to music.

Some receivers have an active vent control. This means a control signal can open and close the vent hole of the earphone. This active vent may be integrated in the receiver case.

It may be desirable to know whether the active vent is working as expected or not. In a device with a vent that can be controlled, it can be decided when to open or when to close the vent. However, it may not necessarily be known whether the vent is actually open or closed. After switching the active vent state from closed to open or from open to closed, it may be desirable to know whether the switch did occur and whether the vent still correctly works.

BRIEF DESCRIPTION OF THE DRAWINGS

The present invention will become more fully understood from the detailed description given hereinbelow and the accompanying drawings which are given by way of illustration only, and thus, are not limiting for the present invention, and wherein.

Corresponding parts are marked with the same reference symbols in all figures.

DETAILED DESCRIPTION

Figure 1:
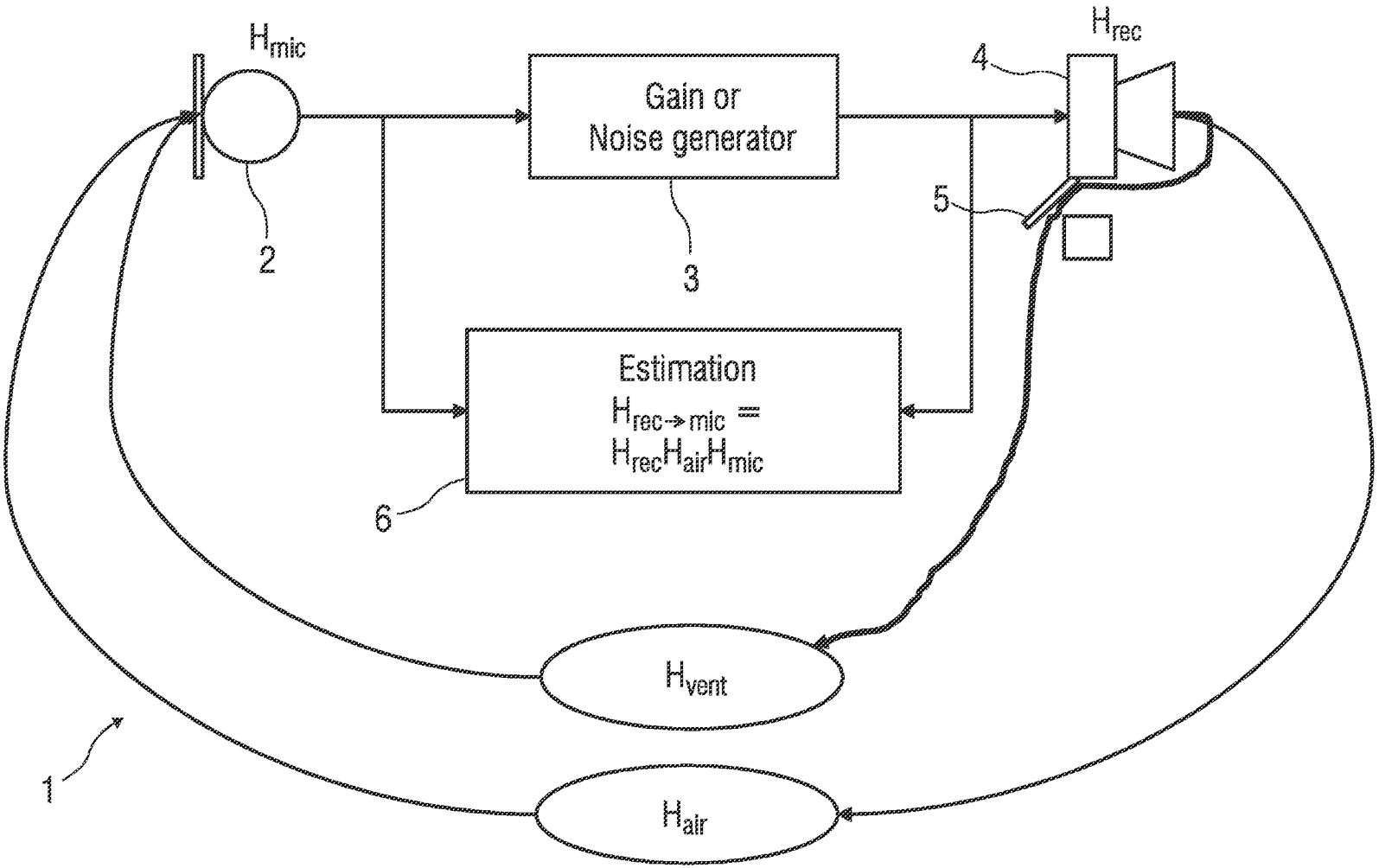
FIG. 1 is a schematic view of an ear piece of a hearing device.

The present application provides an improved method for operating a hearing device and an improved earpiece for a hearing device.

According to an aspect, a method for operating a hearing device is provided, the hearing device comprising a receiver and an active vent, the method comprising: upon request to switch the active vent into a different state, estimating a transfer function from the receiver to obtain a first transfer function, subsequently switching the active vent, subsequently estimating a transfer function from the receiver to obtain a second transfer function, comparing the first transfer function to the second transfer function to obtain a divergence measure, concluding that the active vent has actually been switched into the different state if the divergence measure exceeds a threshold.

The present disclosure proposes to evaluate whether the vent is functioning the right way or not. Since it is difficult to assess this in an absolute way, because transfer functions between the receiver and the microphone heavily depend on the earpiece placement, hearing device orientation etc., it is proposed to make a relative measurement: the transfer function is measured before and after, and a decision is taken following this measure.

In an exemplary embodiment, the hearing device comprises at least one microphone, wherein the first transfer function and the second transfer function are obtained by estimating the transfer function from the receiver to the microphone. In another exemplary embodiment, the first transfer function and the second transfer function are obtained by estimating the transfer function solely from the receiver. In particular, a measurement of at least one property measurable at the receiver, such as the impedance of the receiver, may be employed to determine the transfer function. In another exemplary embodiment, the first transfer function and the second transfer function are obtained by estimating the transfer function from the receiver to at least one other component of the hearing device.

In an exemplary embodiment, the receiver is caused to emit a specific signal (e.g. a white noise, a specific sequence such as a maximum length sequence (MLS), etc.) and the transfer function is estimated based on the emitted signal and a signal picked up by the microphone.

In an exemplary embodiment, the estimation is performed using an IIR or an FIR filter, or in the frequency domain, wherein the estimation is static or adaptive.

In an exemplary embodiment, the divergence measure is computed as the average squared error for the first frequency bins corresponding to low frequencies, (k=0 . . . K−1, K=10) by the equation:

$$D(\hat{H}_a, \hat{H}_b) = \frac{1}{K}\sum_{k=0}^{K-1}\left|\hat{H}_a(k) - \hat{H}_b(k)\right|^2.$$

In an exemplary embodiment, the threshold is at least 10 dB.

In an exemplary embodiment, if the divergence measure exceeds the threshold and if the absolute value of the first transfer function is less than the absolute value of the second transfer function, it is concluded that the current state of the active vent is an open state, and if the absolute value of the first transfer function is greater than the absolute value of the second transfer function, it is concluded that the current state of the active vent is a closed state.

In an exemplary embodiment, after comparison, the smallest transfer function is stored as a reference for the open state and the highest transfer function is stored as a reference for the closed state.

In an exemplary embodiment, if the divergence measure is smaller than a second threshold, it is concluded that: the state of the active vent has remained the same, and/or the active vent is blocked or dirty.

In an exemplary embodiment, the conclusion is taken only after the detection has occurred several times as being the most often detected event or only when the decision is confirmed a certain number of times.

In an exemplary embodiment, the threshold and the second threshold are equal.

In an exemplary embodiment, depending on the conclusion, one or more of the following actions are performed:

Adapting a volume and/or gain in given frequency bands, to reflect an actual loss caused by the active vent, Adapting signal processing algorithms to the current state of the active vent.

Identifying that there is a significant difference between the two states is already a good indication that the vent is working correctly. As a consequence of this knowledge, one can then detect, with some other means, whether the current state is "open" or "closed". For instance, one can then use some reference feature to compare with the currently computed feature. At last, one can then decide, for example, how much gain should be applied, to compensate for the ensuing vent loss and/or avoid a sound pressure level too high in the ear canal, when the vent is closed or clogged.

In an exemplary embodiment, a "defective" flag is set and a user is notified to contact the support.

According to an aspect, an ear piece for a hearing device is provided, comprising at least one microphone, a processing unit, a receiver with an active vent and a transfer function estimation unit, wherein the processing unit and/or the transfer function estimation unit are configured to perform the above described method.

The ear piece may be comprised in a hearing device, wherein the hearing device is a hearing aid or hearing instrument or an earbud.

Further scope of applicability of the present systems and methods will become apparent from the detailed description given hereinafter. However, it should be understood that the detailed description and specific examples, while indicating example embodiments, are given by way of illustration only, since various changes and modifications within the spirit and scope of the invention will become apparent to those skilled in the art from this detailed description.

FIG. 1 is a schematic view of an ear piece 1 of a hearing device, comprising at least one microphone 2, a processing unit 3, a receiver 4 with an active vent 5 and a transfer function estimation unit 6.

In order to determine whether a state S of the active vent 5 has changed, a transfer function H from the receiver 4 is measured before a state S of the active vent 5 is switched to obtain a measured and/or estimated first transfer function $\hat{H}_a$. The current state S of the active vent 5, for instance S=0 when the active vent 5 is closed (or S=1 when it is open), is then switched to the other state, for instance from closed to open, i.e. from S=0 to S=1. The transfer function H is measured a second time, while the active vent 5 is supposedly in the other state S, for instance open (or closed), to obtain the measured and/or estimated second transfer function $\hat{H}_b$.

In some instances, the transfer function H is directly measured at the receiver 4. In particular, a measurement of the impedance of the receiver 4 can be employed to determine the transfer function H. In some instances, the transfer function H is measured from the receiver 4 to the microphone 2, as denoted in FIG. 1 by the transfer function $H_{rec\rightarrow mic}$.

The transfer function $H_{rec\rightarrow mic}$, as shown in FIG. 1, can be estimated in an open loop setup: the processing unit 3 causes the receiver 4 to emit a specific signal (e.g. a white noise, a specific sequence such as a maximum length sequence (MLS), etc.) and the transfer function $H_{rec\rightarrow mic}$ is estimated thanks to the signal picked up by the microphone 2. The estimation can be done via any known transfer function identification algorithm or model, e.g. using an IIR or an FIR filter, or in the frequency domain. The estimation can be static or adaptive. In a closed loop setting, the estimation is also possible using the same models for the underlying filter, except that the algorithm to solve the problem may be more complex to implement requiring decorrelation of the input, and usually with very limited performance in low frequencies. To illustrate, decorrelation of the input may be provided in a hearing device comprising a feedback canceller (FC). The decorrelation may include, for instance, a phase modulation.

The two obtained transfer functions $\hat{H}_a$ and $\hat{H}_b$ can now be compared via any divergence measure $D(\hat{H}_a, \hat{H}_b)$, in time or frequency domain, on limited time or frequency support. For instance, the average squared error for the first frequency bins, corresponding to low frequencies, k=0 . . . K−1, K=10, could be computed as:

$$D(\hat{H}_a, \hat{H}_b) = \frac{1}{K}\sum_{k=0}^{K-1}\left|\hat{H}_a(k) - \hat{H}_b(k)\right|^2$$

Other measures could be used, for instance on other time/frequency supports or in the logarithm domain, using the Itakura-Saito divergence:

$$D_{IS}(\hat{H}_a, \hat{H}_b) = \frac{1}{K}\sum_{k=0}^{K-1}\left|\frac{\hat{H}_a(k)}{\hat{H}_b(k)} - \log\frac{\hat{H}_a(k)}{\hat{H}_b(k)} - 1\right|^2$$

Next, a threshold is defined, which the divergence measure D is supposed to reach and exceed in order to be able to state that the states S of the active vent 5 are indeed sufficiently different, i.e. with a difference as big as expected. For example, the divergence measure D may differ by 10 dB between the two states S.

Note the symmetry of the issue when limiting the task to detect a difference between two states S. This makes the problem less complex, with less trouble and indeterminacies than what would be in, say, the alternative problem of detecting whether the active vent 5 is open or not. With such a problem, it would be required to know what the transfer function $H_{rec\rightarrow mic}$ has to be in an absolute way.

In particular and as an example, assume a model of the transfer function $H_{rec\rightarrow mic}$ which includes several components, namely:

$$H=H_{rec\rightarrow mic}=H_{rec}\cdot H_{vent}\cdot H_{air}\cdot H_{mic}$$

The components are respectively, and in order of appearance in the feedback path, the sensitivity $H_{rec}$ of the receiver 4, the contribution $H_{vent}$ of the active vent 5 (from the receiver 4 to outside the active vent 5), the contribution $H_{air}$ of the space between the active vent 5 and the microphone 2 and at last the sensitivity $H_{mic}$ of the microphone 2. Physically, the sensitivity $H_{rec}$ of the receiver 4 may also depend on the state S of the active vent 5, but assume that this dependency is also modeled through the contribution $H_{vent}$, such that the sensitivity $H_{rec}$ corresponds to intrinsic characteristics of the receiver 4.

All these contributions can be problematic when a diagnose is desired on the contribution $H_{vent}$ of the active vent 5, which is the single contribution of interest for this task. When comparing an estimate of the transfer function $H_{rec \to mic}$ to an absolute reference, say $H_{ref}$, then all these contributions are compared at once, but a discrepancy can come from a failing microphone 2, a clogged receiver 4, or because the ear piece 1 was placed differently compared to when the reference was measured.

By comparing two values of the transfer function $H_{rec \to mic}$, estimated before and after having switched the state S of the active vent 5, it can be expected that the sensitivity $H_{rec}$ of the receiver 4, the sensitivity $H_{mic}$ of the microphone 2 and the placement of the earpiece 1 (in particular related to the contribution $H_{air}$ of the space between the active vent 5 and the microphone 2) all stay the same for each state S. A discrepancy can therefore be relied on between the first transfer function $\hat{H}_a$ before and the second transfer function $\hat{H}_b$ after switching to come mostly from the contribution $H_{vent}$ of the active vent 5.

Figure 2:
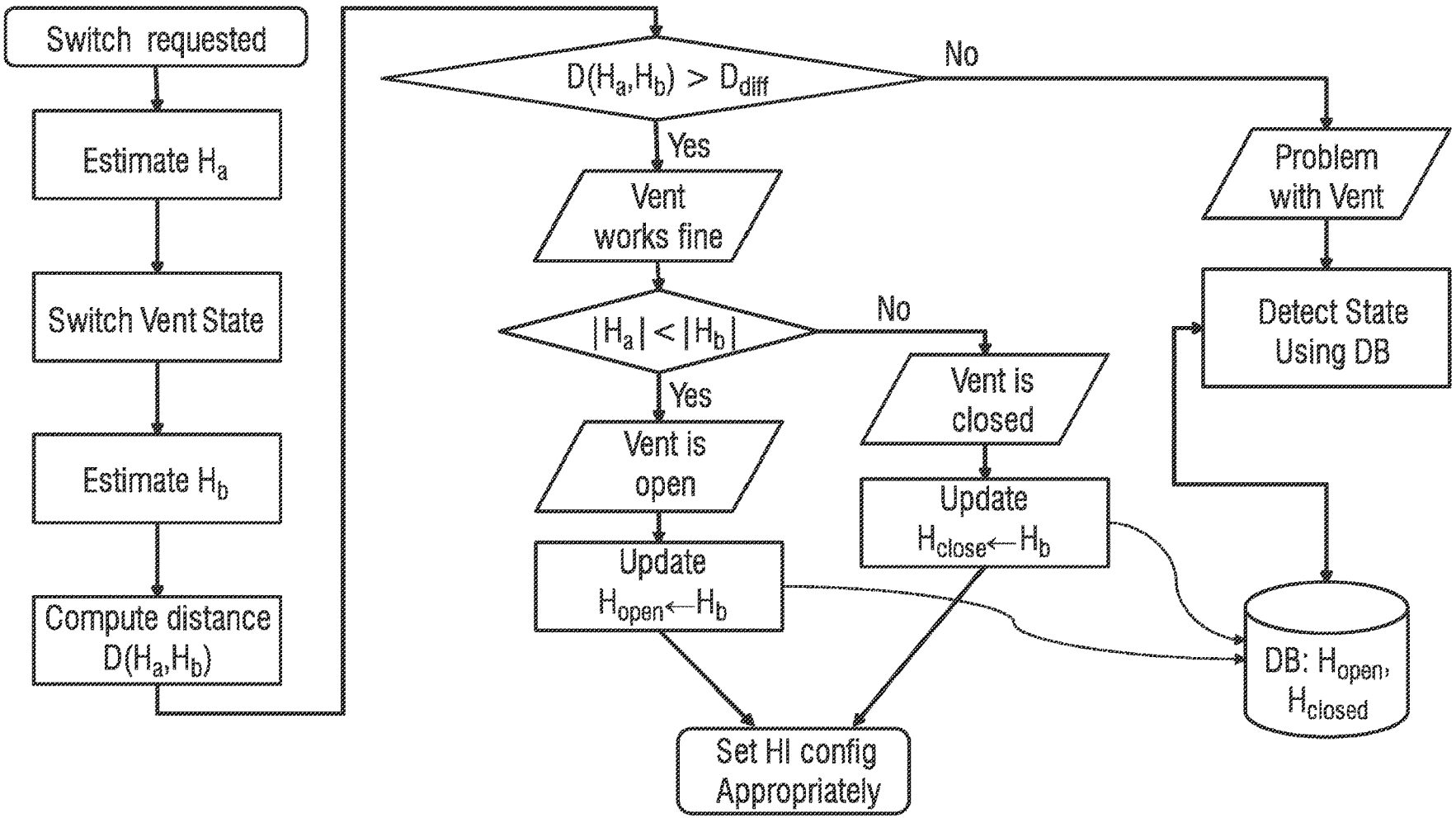
FIG. 2 is a schematic flow chart of a method for operating the hearing device.

FIG. 2 illustrates an algorithm that detects whether the active vent 5 is working correctly, and which, as a byproduct, can also give a hint on detecting in which state S the active vent 5 is. For this a norm is defined for the transfer functions H as, for instance, $|H|=D(H, 0)$.

An exemplary algorithm could be as follows:

Before switching, estimate a first transfer function $H_a$, corresponding to the transfer function H, for instance $H_{rec \to mic}$ Switch the state S of the active vent 5

After switching, estimate a second transfer function $H_b$, which represents the new transfer function H, for instance $H_{rec \to mic}$ Compare the transfer functions $H_a$ and $H_b$, via a divergence measure $D(H_a, H_b)$ a. If the divergence measure $D(H_a, H_b)$ is greater than a threshold $D_{diff}$, then the paths differ. Actions:
   i. Conclusion that the switching happened and the active vent 5 works as expected.
   ii. Compare the transfer functions $H_a$ and $H_b$ to help decide in which state S the active vent 5 currently is.
      1. If $|H_a|<|H_b|$, then it can be assumed that the active vent 5 is now more open and that the current state $S_b$ is an open state of the active vent 5.
      2. Otherwise, the active vent 5 is closed.
   iii. References can be stored, in order to take further decisions: after comparison, store the smallest transfer function H as $H_{open}$ and the highest one as $H_{closed}$.
b. If the divergence measure $D(H_a, H_b)$ is smaller than a second threshold $D_{same}$, then there is no difference. Conclusions:
   i. The switching happened but the state S of the active vent 5 is the same before and after.
   ii. The active vent 5 is blocked or dirty, and the current state S corresponds to the transfer function $H_b$.
   iii. Comparing the transfer function $H_b$ to the stored references saved as described above, it can be inferred what is the most likely current state S. NB: the safest choice would be to set that the current state S of the active vent 5 is Closed, leading to less gain.

Note that the decisions taken after the detection of a defect and/or detection of a state S of the active vent 5 are described herein in a simplified way. The final decision may be made more complex by including more contextual elements, more temporal context, for instance, or a voting mechanism, where the decision is taken only after the detection has occurred several times, as being the most often detected event ("Vent works" or "Defective vent"), or only when the decision is confirmed a certain number of times, for instance if 90% of the previous detections agree on that particular decision. Alternatively, the outcome can be whether the switching of the state S of the active vent 5 was successful or not. If unsuccessful, an ensuing action could be to try again to switch the active vent 5 until success or until a predetermined number of trials has been reached.

In the algorithm described above, the decision thresholds $D_{diff}$ and $D_{same}$ can be different or can be the same as in the exemplary flow chart of an algorithm shown in FIG. 2. The algorithm is as follows:

Before switching, estimate a first transfer function $H_a$, corresponding to the transfer function H, for instance $H_{rec \to mic}$.

Switch the state S of the active vent 5.

After switching, estimate a second transfer function $H_b$, which represents the new transfer function H, for instance $H_{rec \to mic}$.

Compare the transfer functions $H_a$ and $H_b$, via a divergence measure $D(H_a, H_b)$.

a. If the divergence measure $D(H_a, H_b)$ is greater than a threshold $D_{diff}$, then the paths differ. If this is the case, then it is concluded that the switching happened and the active vent 5 works as expected. The transfer functions $H_a$ and $H_b$ are compared to help decide in which state S the active vent 5 currently is. If $|H_a|<|H_b|$, then it can be assumed that the active vent 5 is now more open and that the current state $S_b$ is an open state of the active vent 5. Otherwise, the active vent 5 is closed. References are stored, in order to take further decisions: after comparison, store the smallest transfer function H as $H_{open}$ and the highest one as $H_{closed}$. The configuration of the hearing device may be set accordingly.
b. If the divergence measure $D(H_a, H_b)$ is smaller than the threshold $D_{diff}$, then there is no difference. It is concluded that there is a problem with the active vent 5, e.g. the active vent 5 is blocked or dirty. The transfer function $H_b$ is compared to the references stored in a data base DB to conclude what the present state S is.

This algorithm shown in FIG. 2 is however not limited to this condition, and the decision can also include the second threshold $D_{same}$ as in the previously described algorithm, with an additional action defined when the divergence measure is between $D_{diff}$ and $D_{same}$: for instance, it is assumed that the active vent 5 works, but not as much as desired, and therefore the stored transfer function values are not updated. In this case, it may be assumed that $D_{same}<D_{diff}$. Instead of two "regions", three decision regions could be defined. As above, the region "$D<D_{same}$" is already dealt with and stays the same. If $D_{same}<D<D_{diff}$, then the switch went fine, one can proceed with concluding that the switching happened and the active vent 5 works as expected, as well as with comparing the transfer functions $H_a$ and $H_b$ to help decide in which state S the active vent 5 currently is. The storing of references may however be reserved to the case where the difference is great enough, $D_{diff}<D$, such that it is sure that the difference justifies to store an updated value of the transfer functions for the different states.

Depending on the decision, some actions can be taken, as in the algorithm described above first, which may trigger other actions, such as:

Adapting the volume and/or gain in given frequency bands, to reflect the actual loss caused by the active vent 5.

Adapting signal processing algorithms to the new state S of the active vent 5, especially concerning acoustic stability measures.

The system may be flagged as "defective", and the user may be notified, through a remote control app, to contact the support. This flag could be further analysed by a fitting software, analysing the different states S and the different transfer functions $H_{rec \to mic}$ that were stored so far.

The hearing device may be a hearing aid or hearing instrument or a headphone such as an earbud.

In some instances, the hearing device may comprise a housing configured to be at least partially inserted into an ear canal of the user. The active vent may comprise a venting channel configured to provide for venting between an inner region of the ear canal and an ambient environment outside the ear canal through the venting channel, and an acoustic valve configured to adjust an effective size of the venting channel. The venting channel may extend at least partially through the housing. The acoustic valve may comprise a valve member moveable relative to the venting channel between different positions, wherein the effective size of the venting channel is adjustable by the movement of the valve member between the different positions, and an actuator configured to actuate the movement of the valve member. For instance, the actuator may be configured to provide a magnetic field and/or an electric field to actuate the movement of the valve member.

Independently, another method for operating a hearing device may include the following steps:

requiring a user to keep the hearing device as normally inserted in the ear, estimating a transfer function from the receiver to obtain a first transfer function, requiring the user to manually occlude a vent of the hearing device, subsequently estimating a transfer function from the receiver to obtain a second transfer function, comparing the first transfer function to the second transfer function to obtain a divergence measure, concluding that the vent is occluded if the divergence measure does not exceed a threshold.

In some implementations, the vent may be a static vent. In some implementations, the vent may be an active vent. For instance, a user having a hearing device with an open fitting may be asked to keep the hearing device as normally inserted in the ear, making a measurement, then the user is asked to manually occlude the vent before making the second measurement. As a result, it can be considered that the user manually ensured that the state of the vent is "closed". Depending on the outcome of the measurements, the user may then be alerted of some defect, for instance a vent occluded by earwax.

LIST OF REFERENCES

1 ear piece
2 microphone
3 processing unit
4 receiver
5 active vent
6 transfer function estimation unit
S state
H, $H_{rec \to mic}$ transfer function
$\hat{H}_a$, $H_a$ first transfer function
$\hat{H}_b$, $H_b$ second transfer function
D, $D(\hat{H}_a, \hat{H}_b)$, $D(H_a, H_b)$ divergence measure
$H_{rec}$ sensitivity of the receiver
$H_{vent}$ contribution of the active vent
$H_{air}$ contribution of the space between the active vent and the microphone
$H_{mic}$ sensitivity of the microphone

What is claimed is:

1. A method for operating a hearing device, comprising a receiver and an active vent, the method comprising:

upon request to switch the active vent into a different state, estimating a transfer function (H, $H_{rec \to mic}$) from the receiver to obtain a first transfer function ($\hat{H}_a$), subsequently switching the active vent, subsequently estimating a transfer function (H, $H_{rec \to mic}$) from the receiver to obtain a second transfer function ($\hat{H}_b$), comparing the first transfer function ($\hat{H}_a$) to the second transfer function ($\hat{H}_b$) to obtain a divergence measure (D), concluding that the active vent has actually been switched into the different state if the divergence measure (D) exceeds a threshold ($D_{diff}$), wherein the estimation is performed using an IIR or an FIR filter, or in the frequency domain, wherein the estimation is static or adaptive.

2. The method of claim 1, wherein the hearing device comprises at least one microphone, wherein the first transfer function ($\hat{H}_a$) and the second transfer function ($\hat{H}_b$) are obtained by estimating the transfer function (H, $H_{rec \to mic}$) from the receiver to the microphone.

3. The method of claim 2, wherein the receiver is caused to emit a specific signal and the transfer function (H, $H_{rec \to mic}$) is estimated based on the emitted signal and a signal picked up by the microphone.

4. The method of claim 1, wherein the divergence measure (D) is computed as an average squared error for first frequency bins corresponding to low frequencies, (k=0 . . . K−1, K=10) by the equation:

$$D(\hat{H}_a, \hat{H}_b) = \frac{1}{K}\sum_{k=0}^{K-1}\left|\hat{H}_a(k) - \hat{H}_b(k)\right|^2.$$

5. The method of claim 1, wherein the threshold ($D_{diff}$) is at least 10 dB.

6. The method of claim 1, wherein, if the divergence measure (D) exceeds the threshold ($D_{diff}$), and if the absolute value of the first transfer function ($\hat{H}_a$) is less than the absolute value of the second transfer function ($\hat{H}_b$), it is concluded that a current state ($S_b$) of the active vent is an open state, and if the absolute value of the first transfer function ($\hat{H}_a$) is greater than the absolute value of the second transfer function ($\hat{H}_b$), it is concluded that the current state ($S_b$) of the active vent is a closed state.

7. The method of claim 1, wherein after comparison, a smallest transfer function (H, $H_{rec \to mic}$) is stored as a reference for an open state and a highest transfer function (H, $H_{rec \to mic}$) is stored as a reference for a closed state.

8. The method of claim 1, wherein, if the divergence measure $D(H_a, H_b)$ is smaller than a second threshold ($D_{same}$), it is concluded that:

the state (S) of the active vent has remained the same, and/or the active vent is blocked or dirty.

9. The method of claim 8, wherein the conclusion is taken only after the detection has occurred several times as being the most often detected event or only when the decision is confirmed a certain number of times.

10. The method of claim 8, wherein the threshold ($D_{diff}$) and the second threshold ($D_{same}$) are equal.

11. The method of claim 8, wherein a defective flag is set and a user is notified to contact support.

12. The method of claim 1, wherein depending on the conclusion, one or more of the following actions are performed:

adapting a volume and/or gain in given frequency bands, to reflect an actual loss caused by the active vent, adapting signal processing algorithms to the current state (S) of the active vent (5).

13. An ear piece for a hearing device, comprising a processing unit, a receiver with an active vent and a transfer function estimation unit, wherein the processing unit and/or the transfer function estimation unit are configured to perform the method according to claim 1.

14. A method for operating a hearing device, comprising a receiver and an active vent, the method comprising:

upon request to switch the active vent into a different state, estimating a transfer function ($H$, $H_{rec \to mic}$) from the receiver to obtain a first transfer function ($\hat{H}_a$), subsequently switching the active vent, subsequently estimating a transfer function ($H$, $H_{rec \to mic}$) from the receiver to obtain a second transfer function ($\hat{H}_b$), comparing the first transfer function ($\hat{H}_a$) to the second transfer function ($\hat{H}_b$) to obtain a divergence measure (D), concluding that the active vent has actually been switched into the different state if the divergence measure (D) exceeds a threshold ($D_{diff}$), wherein the threshold ($D_{diff}$) is at least 10 dB.

* * * * *